US007377771B2

(12) United States Patent
Wiesenberg et al.

(10) Patent No.: US 7,377,771 B2
(45) Date of Patent: May 27, 2008

(54) APPARATUS FOR THE THERMAL TREATMENT OF PROCESS EXHAUST GASES CONTAINING POLLUTANTS

(75) Inventors: Wido Wiesenberg, Dresden (DE); Andreas Frenzel, Dresden (DE); Konrad Gehmlich, Meiβen (DE); Horst Reichardt, Dresden (DE); Lothar Ritter, Langebrück (DE); Corina Kloβ, Dresden (DE); Michael Hentrich, Dresden (DE)

(73) Assignee: DAS-Dunnschicht Anlagan Systeme GmbH, Dresden (DE)

( * ) Notice: Subject to any disclaimer, the term of this patent is extended or adjusted under 35 U.S.C. 154(b) by 156 days.

(21) Appl. No.: 10/937,526

(22) Filed: Sep. 9, 2004

(65) Prior Publication Data

US 2005/0064353 A1 Mar. 24, 2005

(30) Foreign Application Priority Data

Sep. 9, 2003 (DE) ..... 103 42 692

(51) Int. Cl.
*F23D 14/58* (2006.01)
*F23J 15/04* (2006.01)

(52) U.S. Cl. ..... 431/190; 431/181; 431/121; 110/215; 422/168

(58) Field of Classification Search ..... 431/202, 431/5, 181, 187, 190, 351, 121, 32, 29, 3; 110/215; 422/168
See application file for complete search history.

(56) References Cited

U.S. PATENT DOCUMENTS

| | | | | |
|---|---|---|---|---|
| 4,327,057 A | | 4/1982 | Brüning et al. | |
| 4,801,437 A | * | 1/1989 | Konagaya et al. | 423/210 |
| 4,862,814 A | * | 9/1989 | Campbell et al. | 110/264 |
| 4,927,353 A | * | 5/1990 | Nomura et al. | 431/215 |
| 5,123,836 A | * | 6/1992 | Yoneda et al. | 431/5 |
| 5,217,362 A | * | 6/1993 | Thompson et al. | 431/11 |
| 5,527,984 A | * | 6/1996 | Stultz et al. | 431/5 |
| 5,693,293 A | | 12/1997 | Reichardt et al. | |
| 5,735,683 A | | 4/1998 | Muschelknautz | |
| 6,524,096 B2 | * | 2/2003 | Pribish | 431/8 |
| 2003/0152882 A1 | * | 8/2003 | Seo et al. | 431/353 |

FOREIGN PATENT DOCUMENTS

| | | |
|---|---|---|
| DE | 74 12 444 | 10/1974 |
| DE | 79 29 723 U | 2/1980 |
| DE | 23 60 187 C2 | 7/1985 |
| DE | 43 20 044 A1 | 12/1994 |
| DE | 44 18 014 A1 | 11/1995 |
| DE | 196 31 873 C1 | 10/1997 |

* cited by examiner

*Primary Examiner*—Josiah C. Cocks
(74) *Attorney, Agent, or Firm*—Leydig, Voit & Mayer, Ltd.

(57) ABSTRACT

The invention relates to an apparatus for the thermal treatment of process exhaust gases containing pollutants, which can be used for a very wide range of surface modification processes carried out under a vacuum. The intention is to achieve the object of thermally treating process exhaust gases containing pollutants in such a way that accumulations of particles on the inner wall of a combustion chamber and an undesirable adverse effect on the thermal conversion can be avoided with little outlay.

18 Claims, 6 Drawing Sheets

APPARATUS FOR THE THERMAL TREATMENT OF PROCESS EXHAUST GASES CONTAINING POLLUTANTS

This application claims priority to German patent application No. 103 42 692.2, filed Sep. 9, 2003, which is hereby incorporated by reference.

The invention relates to an apparatus for the thermal treatment of process exhaust gases containing pollutants, as used or formed extensively, in particular in a very wide range of surface modification processes carried out under a vacuum. Process exhaust gases of this type contain toxic compounds or elements which cannot be released directly to atmosphere. In addition to process exhaust gases from CVD or PVD processes of this type, it is also possible to treat exhaust gases from other processes which contain pollutants by means of the invention.

In this context, chlorine, fluorine, silicon, arsenic and gallium, as well as compounds containing these elements, are particularly critical.

With an increase in demand for substrates which have been modified in this way, there is accordingly also an increasing proportion of process exhaust gases which have to be subjected to a treatment in order to ensure that they are harmless to environment and health.

For example, it has long been known to thermally treat process exhaust gases in such a way that the harmful elements and chemical compounds are if appropriate broken down and converted by chemical reaction into harmless chemical compounds. Predominantly oxides are formed.

U.S. Pat. No. 5,123,836 has demonstrated options in this respect, and has also referred to a further problem. This problem is that thermal processes of this type form particles which lead to deposits on chamber walls and also impair the functioning of burners which are usually used for this purpose.

The larger installations for surface modifications of this nature that have been used in recent times and will continue to be used in future produce correspondingly greater volumetric flows of process exhaust gases, with correspondingly greater quantities of particles.

Accordingly, in this prior art it is also proposed to arrange a burner at the cover of a chamber, from which burner a treatment/combustion flame is directed into the chamber.

To prevent particles from settling on and/or sticking to the inner wall of the chamber, a film of water is to be produced there. For this purpose, the water is sprayed into the chamber from the side; in an embodiment which is referred to as being preferred in the above document, the water is also to be sprayed upward onto the cover, as far as the burner.

In this form, however, it is not readily possible to form a film of water which is always continuous over the entire inner wall. Furthermore, some of the water is evaporated, so that it cannot be fully utilized to discharge particles. Moreover, the evaporation reduces the temperature and additionally impedes the combustion process.

Also, it is easier for accumulations which can have an adverse effect on the combustion and/or can lead to blockages at gas feeds to be formed at a humidified cover.

Therefore, it is an object of the invention to create a possible way of thermally treating process exhaust gases containing pollutants in which the sticking of particles to the inner wall of a combustion chamber and an undesirable adverse effect on the thermal conversion are to be avoided with little outlay.

This object preferably is achieved by the characterizing features of the present invention. Advantageous embodiments and further developments of the solution will be apparent from the description of the invention provided herein.

The apparatus according to the invention has a combustion chamber at which there is at least one burner at a cover arranged at the top, so that a flame is directed from the top downwards into the interior of the combustion chamber. Moreover, there is a feed for a washing liquid, by means of which a continuous film can be formed on the entire inner lateral surface of the combustion chamber. According to the invention, however, that part of the cover with burner(s) which faces into the interior is not to be wetted.

The washing liquid may be pure water. However, it may also contain additives which are preferably responsible for neutralization. Accordingly, a washing liquid may contain a base.

A discharge for exhaust gas from the thermal treatment and washing liquid containing particles in colloidal form is arranged at the base of the combustion chamber.

The feed for the washing liquid is in this case arranged immediately below the cover. It is designed in such a way that the washing liquid forms the continuous film on the inner lateral surface on the combustion chamber exclusively under the force of gravity, i.e. the washing liquid simply runs uniformly down to the lateral surface all the way around in the radial direction without any pressure being applied to force the washing liquid into the combustion chamber.

Moreover, it is expedient for the inner lateral surface of the combustion chamber to be designed in a form which is curved radially convexly outwards and is rotationally symmetrical about the longitudinal axis of the combustion chamber, so that starting from the cover it is possible for the clear width inside the combustion chamber to increase as far as possible continuously until a maximum clear width is reached, and then for the width to be continuously reduced again.

However, taking account of the interfacial conditions between washing liquid and surface of the inner lateral face, the shape of the combustion chamber should also ensure that the continuous film is maintained over the entire surface area.

The interfacial conditions between inner lateral surface of the combustion chamber and film of washing liquid may also be influenced by the surface of the inner lateral face. This surface should have a surface roughness in the range from 100 to 300 μm.

The form of the inner lateral surface may be predetermined by the shaping of the chamber wall of the combustion chamber. However, it is also possible for the external configuration of the combustion chamber to be selected independently of the shape of the inner lateral surface. By way of example, it is possible for an insulation to be present on the outside of the combustion chamber, and this insulation may then also adopt a different form, for example the shape of a cylinder.

It is also not imperative that a convex curvature have a constant radius from the cover to the base of the combustion chamber, but rather it is merely appropriate to avoid sudden step changes. By way of example, the inner lateral surface may be curved in the shape of a parabola.

In one preferred embodiment, the feed for the washing liquid may have an annular channel which radially encircles the combustion chamber and to which washing liquid is fed from the outside at a sufficiently high, predeterminable volumetric flow. At the annular channel there is an overflow edge which faces towards the interior of the combustion chamber and over which the washing liquid can run down. The overflow edge in this case forms the top edge of the inner lateral surface.

The overflow edge should be directed horizontally over the entire periphery, so that an at least approximately constant volumetric flow can run down over the entire periphery and form the film on the inner lateral surface. It will be obvious that the volumetric flow of washing liquid supplied should correspond to the volumetric flow running down over the overflow edge.

The washing liquid should be introduced into the annular channel via at least one tangentially oriented feed line, so that a flow of the washing liquid with a low flow velocity is produced in the annular channel. However, it is more expedient to provide two diametrically opposite, tangentially oriented feed lines at an annular channel. However, it is also possible for there to be more than two such feed lines, which should then as far as possible be arranged at regular angular intervals.

However, a plurality of feed lines should also be oriented in such a way that the washing liquid is introduced into the annular channel in the same direction of flow.

The tangential flow of the washing liquid in the annular channel substantially performs the task of ensuring a sufficiently high level in the annular channel, so that a continuous film is formed over the entire inner lateral surface of the combustion chamber.

However, a flow of this type can also counteract the formation of accumulations and deposits at the overflow edge and/or in the annular channel.

The annular channel may be open at the top and/or the overflow edge may also be formed by a radially encircling annular gap.

Moreover, there should be a further feed for a purge gas, so that the cover and burner and also process exhaust gas feeds in the combustion chamber are protected from washing liquid, and cannot be wetted by it, by means of a purge gas flow.

The purge gas flow can also prevent or at least impede the formation of condensate in this region.

Furthermore, undesirable chemical reactions which lead to solid deposits are also avoided. Solids which are nevertheless formed remain dry and can be blown off by the purge gas flow, so that that part of the cover which faces into the interior of the combustion chamber can be kept clear.

As a result, it is possible to use a reduced cover diameter.

Inert gases, such as for example nitrogen, can preferably be used as purge gas.

The feed for purge gas into the combustion chamber may be designed as an annular arrangement of discretely arranged nozzles or nozzle slots or as a continuously encircling annular gap. The outlet opening(s) for purge gas should be arranged close to the feed for the washing liquid. The purge gas pressure should be sufficient to prevent wetting of the regions and parts which are to be protected.

The at least one burner may be supplied with a fuel gas. The fuel gas composition may in this case be selected in such a way that a sufficiently high temperature and stoichiometric conditions, which are favourable for the thermal treatment, can be achieved in the flame, taking account of the respective composition of process exhaust gases that are to be treated.

Ignition apparatuses, making it possible, for example, to achieve spark ignition of the flame, may also be present at burners.

However, it is also possible to use plasma torches as well as burners operated with fuel gases. These plasma torches may be arc or microwave plasma sources. An appropriate selection can be made taking account of the particular volumetric flows of process exhaust gas to be treated. For example, arc plasma sources are to be preferred in the event of relatively high volumetric flows.

The process exhaust gas which is to be treated may at least in part be introduced directly into a plasma torch and used for plasma formation; if appropriate, it is then possible to dispense with the supply of additional fuel gases or to implement a reduced supply of gases.

The invention makes it possible to achieve favourable conditions for the complete discharge of particles formed during the treatment without accumulations occurring at the inner wall of the combustion chamber, and also for the thermal treatment itself. In the latter case, the geometric configuration of the inner lateral surface is also advantageous in thermal terms (combustion temperature, cooling) and with regard to the flow conditions in the combustion chamber.

The apparatus according to the invention can be operated without faults and without maintenance for prolonged periods of time. It is easy to match it to different process exhaust gases to be treated. For example, it is possible to use differently configured covers with correspondingly adapted burner and process exhaust gas feed arrangements or to change between various covers.

The invention is to be explained in more detail below on the basis of examples. In the drawing.

Figure 1:
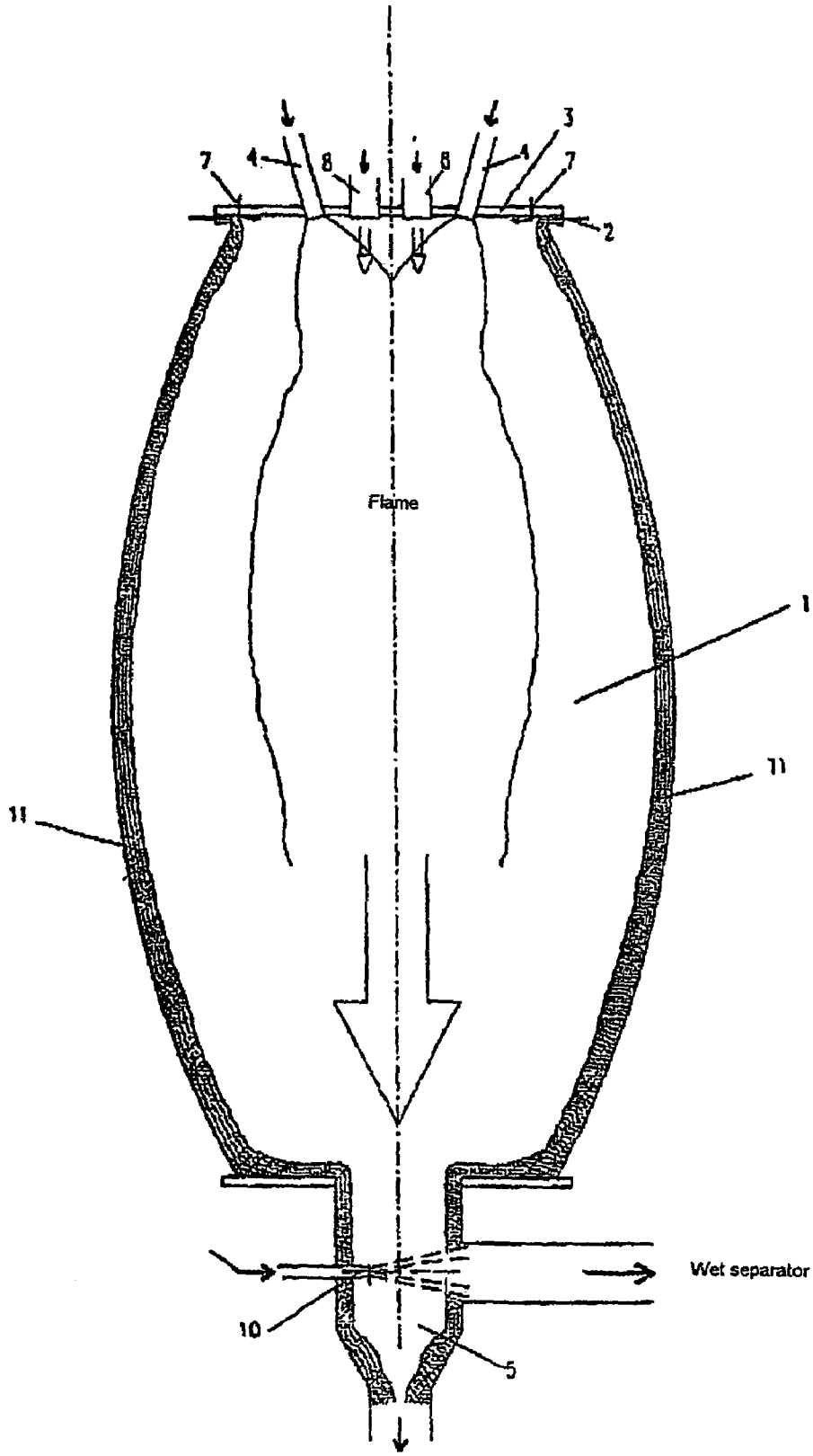
FIG. 1 shows an example of an apparatus according to the invention in the form of a diagrammatic, sectional illustration.

FIG. 1 diagrammatically depicts an example of an apparatus according to the invention.

The chamber wall of the combustion chamber 1 is curved radially convexly outwards from the cover 3, arranged at the top, to the base, resulting also in a corresponding shape of the inner lateral surface.

The form is also designed to be rotationally symmetrical about the longitudinal axis (dot-dashed line) of the combustion chamber 1.

Immediately beneath the cover 3 there is arranged a feed 2 for washing liquid, via which the washing liquid is made to overflow so as to form a continuous film 11 over the entire inner lateral surface. The result of this is that that part of the cover 3 which faces towards the inside remains dry and is not wetted by the washing liquid.

This effect is additionally boosted by a flow of purge gas. A purge gas is introduced into the combustion chamber 1 via feeds 7. The feeds for purge gas are in this case arranged between feed 2 for washing liquid and cover 3 with burner 4 and process exhaust gas feeds 8, so that these elements are likewise protected from washing liquid and can be kept dry.

The example shown here uses a plurality of burners 4 which are arranged radially outward, at a distance from the longitudinal axis of the combustion chamber 1. Between the burners 4, i.e. closer to the longitudinal axis, there is arranged at least one, but in this case a plurality of, process exhaust gas feeds 8. Process exhaust gases that are to be treated are introduced into the combustion chamber 1 through the process exhaust gas feeds 8; premixing, in a form which is not illustrated, with an additional gas or gas mixture which is required for or promotes the thermal treatment may already have taken place.

Premixing can also be provided for the burners 4, for example by process exhaust gas being admixed to a fuel gas.

As is clear from FIG. 1, the burners 4 are oriented at an obliquely inclined angle in each case towards the centrally arranged longitudinal axis of the combustion chamber 1, so that the process exhaust gases that are to be treated flow in directly between flames of the burners 4 and inevitably enter the region of influence of the latter.

The shape of the inner lateral surface of the combustion chamber 1 results in a continuous increase in the clear width, starting from the cover, until this width reaches a maximum. This maximum may, for example, be arranged half way between the cover 3 and the base of the combustion chamber 1. From there, the clear width is reduced again towards the base.

A discharge 5 for washing liquid containing particles and the thermally treated exhaust gases is present at the base.

In the example shown here, a spray nozzle 10, the spray jet of which is oriented orthogonally with respect to the longitudinal axis of the combustion chamber 1, is additionally present at the discharge 5. However, the spray jet may also be oriented vertically or inclined obliquely upwards.

The spray nozzle 10 is preferably designed as a two-fluid nozzle for a liquid/gas mixture.

With the aid of the spray jet, it is possible to remove particles which have not previously been captured by the washing liquid running down from the exhaust gas and, as shown, to feed them to a wet separator. Moreover, vapour formed during the treatment can be condensed and discharged with the washing liquid.

The washing liquid contaminated with particles can be fed to a solids separator, in a form which is not illustrated, and then returned to the circuit once it is free of particles.

In the figures described below, identical elements are denoted by the same reference numerals as those used in FIG. 1.

Figure 2:
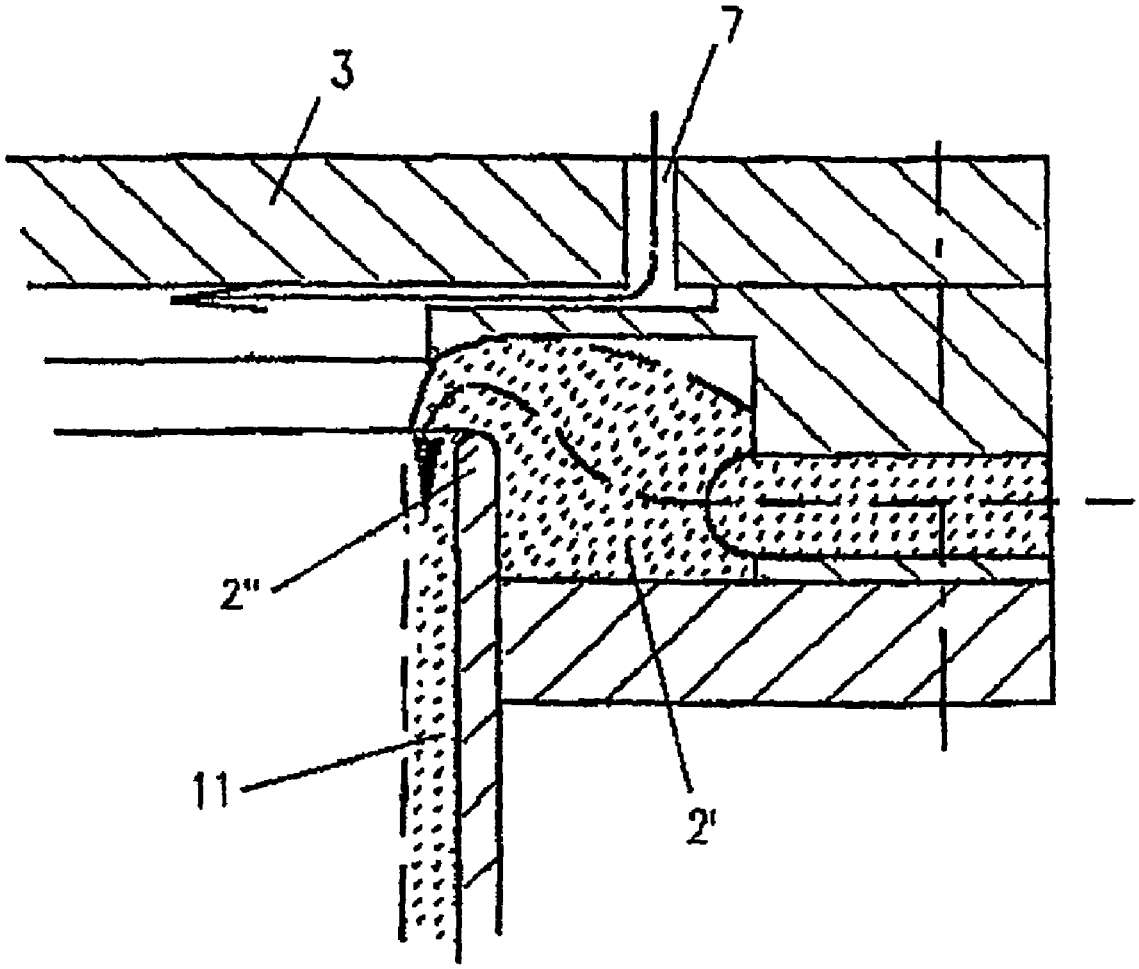
FIG. 2 shows an enlarged excerpt with a feed for a washing liquid.

FIG. 2 shows an enlarged excerpt at the outer upper edge of an apparatus with feed 2 for washing liquid.

An encircling annular channel 2', into which washing liquid is fed, is present immediately beneath the cover 3, so that when the apparatus is operating this channel is always sufficiently full to ensure that washing liquid can run down over a likewise encircling overflow edge 2", which is present at the annular channel 2', over the entire periphery and can thereby form the continuous film 11 over the entire inner lateral surface of the combustion chamber 1 without further forces in addition to the force of gravity being applied to the washing liquid.

FIG. 2 also illustrates a feed 7 for a purge gas. The feed 7 is likewise arranged on the radially outer side, so that a purge gas flow is formed between feed 2 for washing liquid and cover 3, protecting the cover 3 together with the further elements arranged thereon from being wetted by washing liquid.

The purge gas in this case passes through an encircling annular gap into the annular chamber 1, which is arranged immediately below the cover 3, so that a film of purge gas is formed along the inwardly facing part of the cover 3, preventing or at least impeding particles or other solids from adhering to it and also allowing any solids which do adhere to it to be blown off.

The purge gas used may preferably be nitrogen or compressed air.

Figure 3:
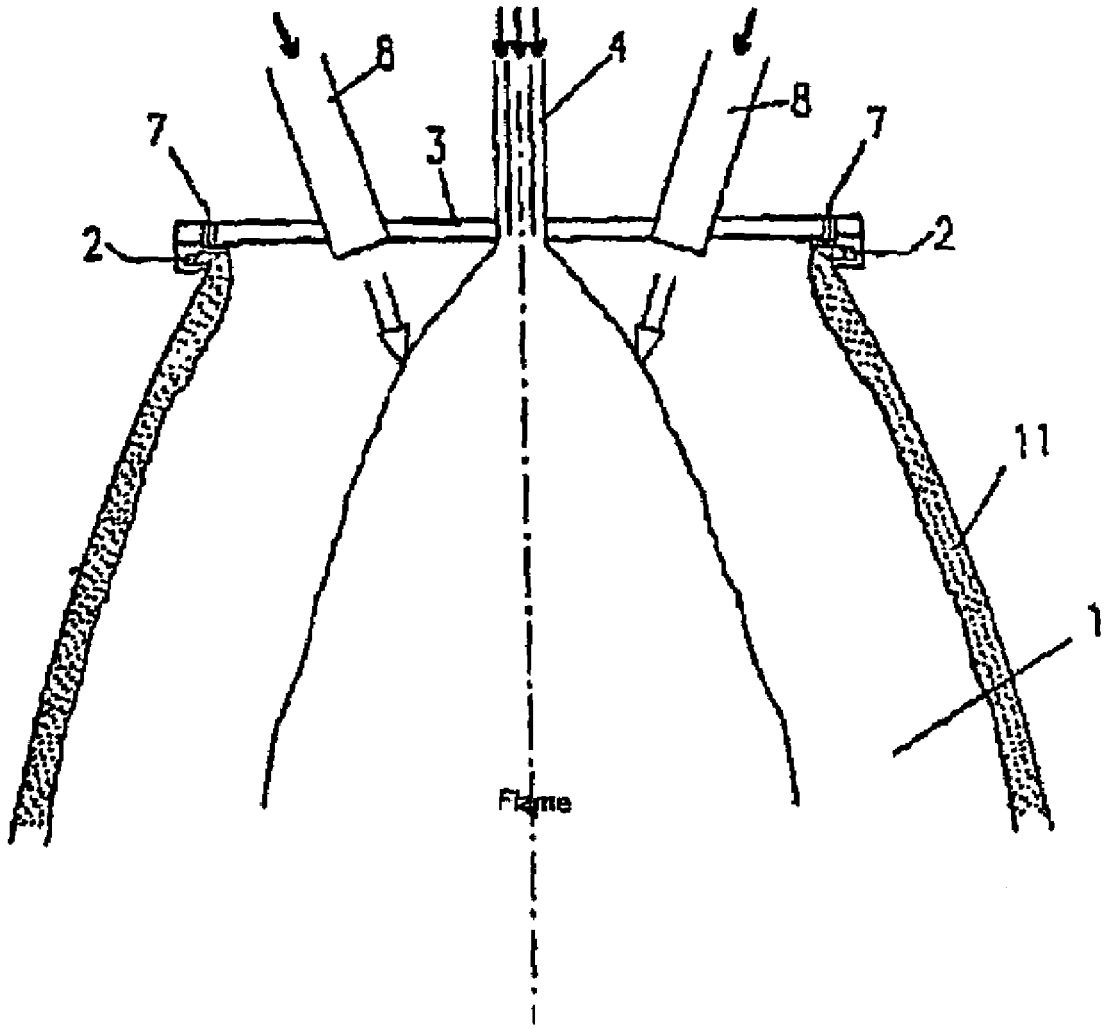
FIG. 3 shows a part of an apparatus with a central arrangement of a burner.

FIG. 3 shows another possible arrangement of burner 4 and process exhaust gas feeds 8. In this case, a burner 4 is arranged centrally on the longitudinal axis of the combustion chamber 1. Further towards the outside in the radial direction, two or more than two process exhaust gas feeds 8 are arranged at a distance from the burner 4. The arrangement should be symmetrical.

In this case, the process exhaust gas feeds 8, and accordingly also the direction of flow of the process exhaust gases introduced into the combustion chamber 1, are oriented obliquely towards the longitudinal axis of the combustion chamber 1 and accordingly into the flame of the burner 4.

Figure 4:
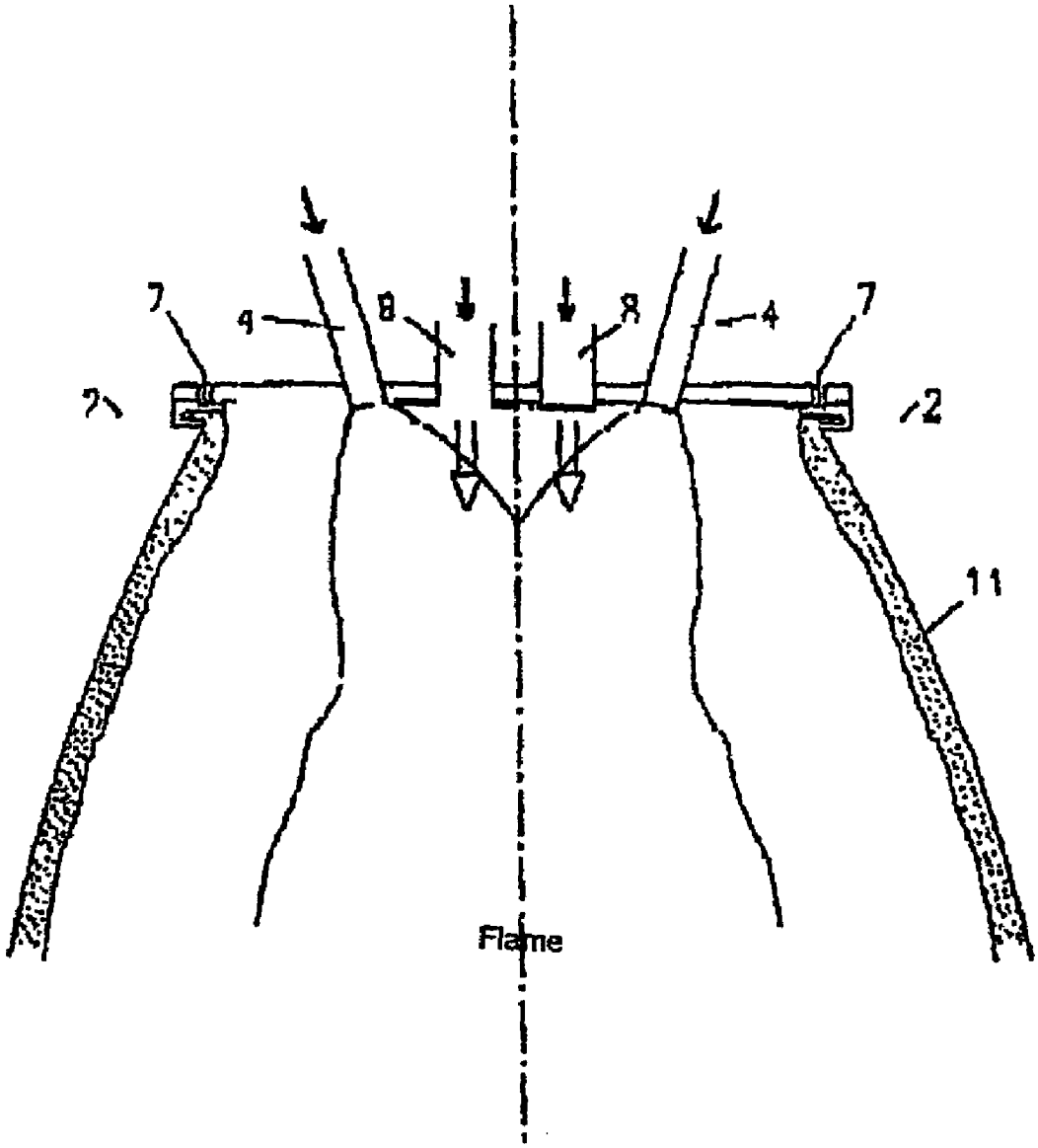
FIG. 4 shows part of an apparatus with a plurality of radially outwardly arranged burners.
Figure 5:
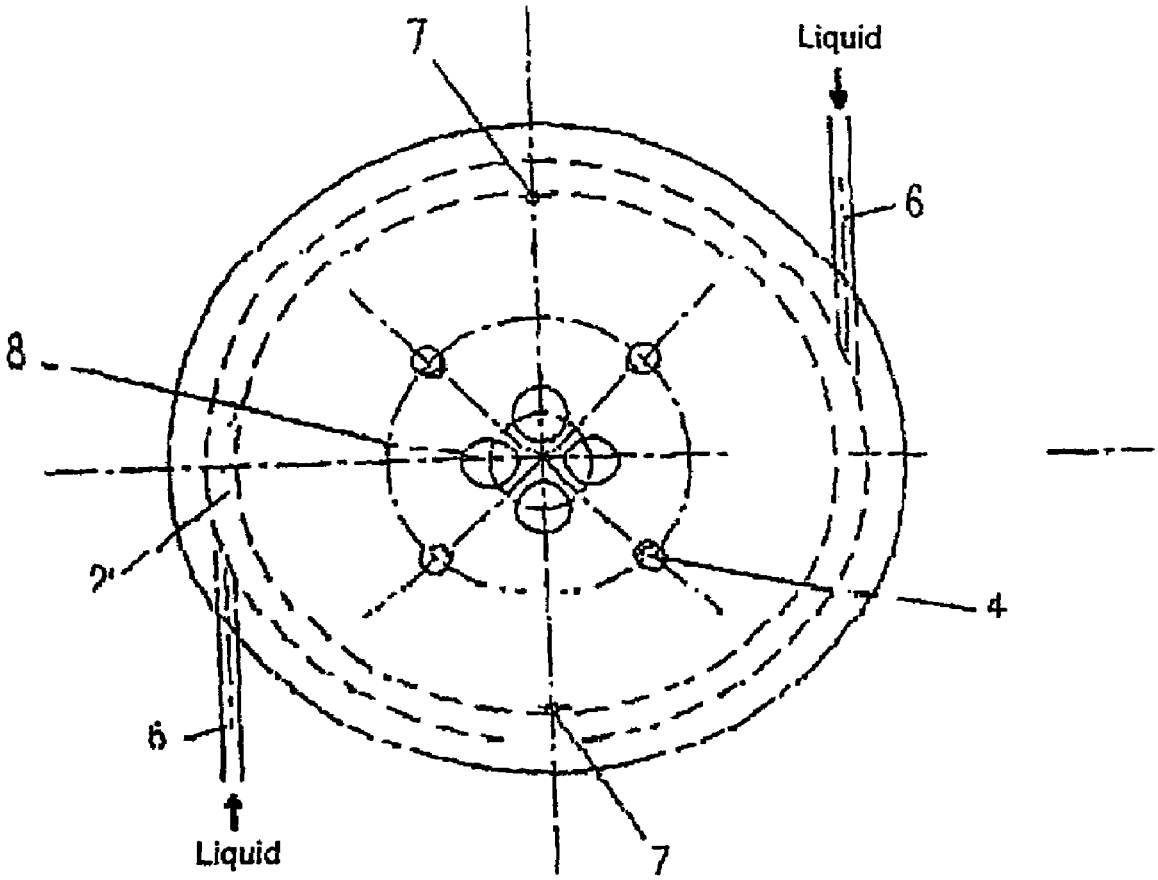
FIG. 5 shows a diagrammatic illustration of an arrangement of a plurality of burners with feeds for process exhaust gas.

FIGS. 4 and 5 are intended to demonstrate possible arrangements of a plurality of burners 4 and process exhaust gas feeds 8.

In this case, a total of four burners 4 form a quasi-annular arrangement around likewise four process exhaust gas feeds 8, which are arranged discretely from one another in a star shape. The burners 4 and accordingly also their respective flames are directed obliquely inwards and downwards, so that the flames form a "ring", into which the process exhaust gases to be treated and any additional gases which are required for or promote the thermal treatment are introduced within the flame ring into the combustion chamber 1 and then inevitably enter the region of influence of the flames.

The burners 4 and also the process gas feeds 8 are each arranged equidistantly from one another and at regular angular intervals with respect to one another.

FIG. 5 also reveals how two feed lines 6 for washing liquid may be arranged and oriented, allowing washing liquid to flow into the annular channel 2' in order to achieve virtually constant filling of the annular channel 2' over its entire periphery.

Figure 6:
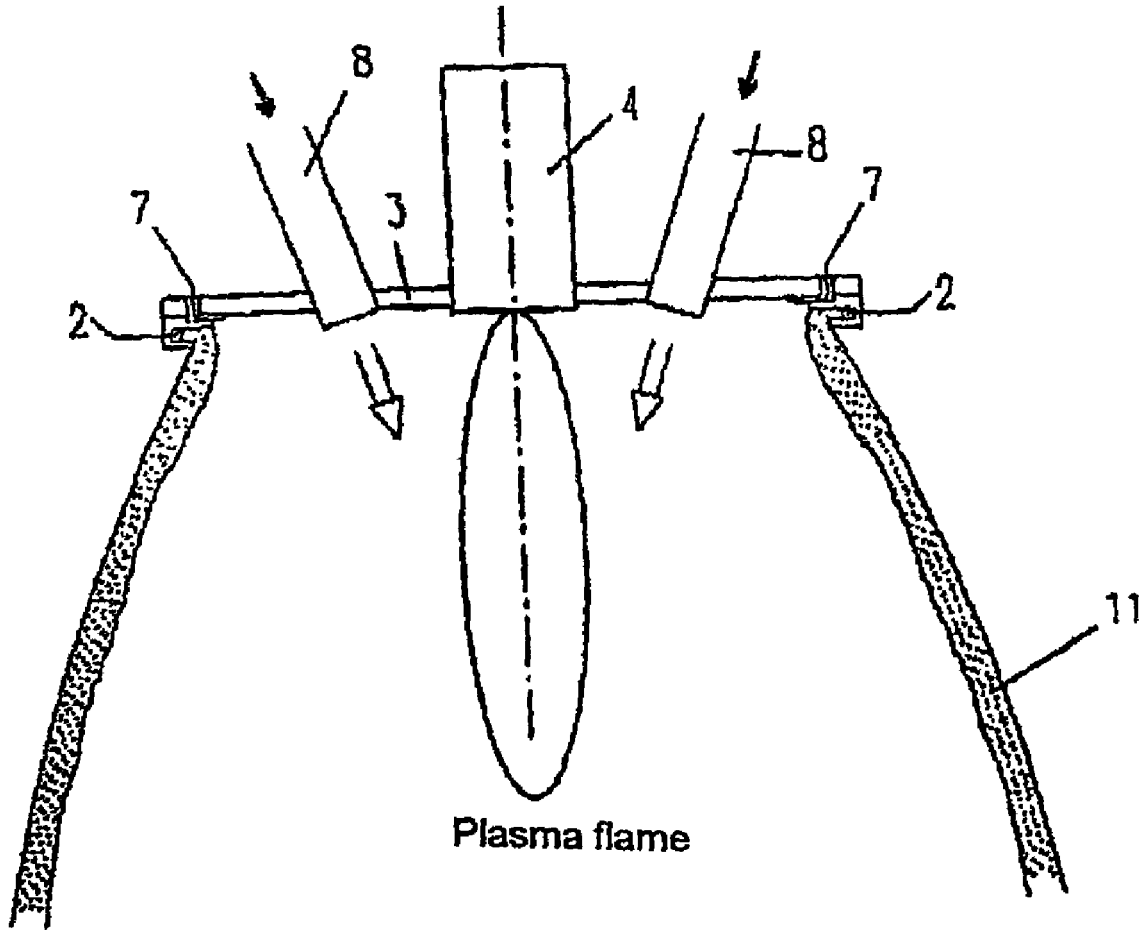
FIG. 6 shows an apparatus with a plasma torch.

FIG. 6 shows an example in which a plasma torch 4 and, in a similar way to the example shown in FIG. 3, a plurality of process exhaust gas feeds 8 are arranged and oriented.

The invention claimed is:

1. Apparatus for the thermal treatment of process exhaust gases containing pollutants, comprising a combustion chamber, in a top cover of which there is arranged at least one burner with a process exhaust gas feed, a feed for washing liquid, which forms a film for the discharge of particles on the inner wall of the combustion chamber, and a discharge for exhaust gas and washing liquid arranged at the bottom of the combustion chamber, wherein the feed for the washing liquid is arranged immediately beneath the cover and is designed in such a way that a continuous film forms over the entire inner lateral surface of the combustion chamber exclusively as a result of the force of gravity, and that part of the cover with burner(s) which faces into the interior of the combustion chamber is not wetted by the washing liquid, and the feed for the washing liquid is designed with a radially encircling annular channel and an overflow edge, which faces toward the interior of the combustion chamber, and the overflow edge forms the top of the inner lateral surface.

2. Apparatus according to claim 1, wherein the inner lateral surface of the combustion chamber, starting from the cover all the way to the discharge is of a form which is curved convexly outwards and is rotationally symmetrical about the longitudinal axis of the combustion chamber.

3. Apparatus according to claim 1, wherein at least one tangentially oriented feed line for washing liquid is connected to the annular channel.

4. Apparatus according to claim 1, wherein feeds for a purge-gas flow, which protects the cover and/or burner from washing liquid, are arranged between the cover and feed for washing liquid.

5. Apparatus according to claim 1, wherein a feed for a purge gas is designed as a radially encircling annular gap or as gaps which are to be arranged discretely with respect to one another at the combustion chamber.

6. Apparatus according to claim 1, wherein a fuel gas is fed to the at least one burner.

7. Apparatus according to claim 1, wherein an ignition apparatus is present at the burner(s).

8. Apparatus according to claim 1, the wherein at least one burner is a plasma torch.

9. Apparatus according to claim 1, the wherein at least one burner is an arc plasma or microwave plasma source.

10. Apparatus according to claim 1, wherein at least some of the process exhaust gas is fed to the at least one burner.

11. Apparatus according to claim 1, wherein process exhaust gas feeds are oriented at an angle which is inclined obliquely towards a flame or the plasma of a burner.

12. Apparatus according to claim 1, wherein there are a plurality of burners with a plurality of flames, the flames being oriented at obliquely inclined angles with respect to at least one process exhaust gas feed.

13. Apparatus according to claim 1, wherein a plurality of burners and/or process exhaust gas feeds are in each case arranged symmetrically with respect to the longitudinal axis of the combustion chamber.

14. Apparatus according to claim 1, wherein burners are in each case arranged on the radially outer side with respect to at least one process exhaust gas feed.

15. Apparatus according to claim 1, wherein the inner lateral surface of the combustion chamber is continuously curved.

16. Apparatus according to claim 1, wherein a spray nozzle is arranged in the region of the base of the combustion chamber or at the discharge for washing liquid and exhaust gas.

17. Apparatus according to claim 1, wherein the spray nozzle is designed as a two-fluid nozzle for a gas/liquid mixture.

18. Apparatus according to claim 1, wherein the surface of the inner lateral face of the combustion chamber has a surface roughness of from 100 to 300 μm.

* * * * *